US005470209A

United States Patent [19]

Hartley et al.

[11] Patent Number: 5,470,209

[45] Date of Patent: Nov. 28, 1995

[54] OFFSET RECIPROCABLE DEVICE

[75] Inventors: E. Dale Hartley, Malibu; F. Scott Hartley, Camarillo, both of Calif.

[73] Assignee: Shurflo Pump Manufacturing Co., Santa Ana, Calif.

[21] Appl. No.: 135,735

[22] Filed: Oct. 13, 1993

[51] Int. Cl.[6] ..... F04B 35/02

[52] U.S. Cl. ..... 417/401; 417/393; 417/395; 417/46; 91/341 R; 91/348

[58] Field of Search ..... 417/43, 46, 393, 417/395, 401; 91/329, 348, 341 R

[56] References Cited

U.S. PATENT DOCUMENTS

| | | | |
|---|---|---|---|
| 3,207,080 | 9/1965 | Schlosser | 417/393 |
| 4,172,698 | 10/1979 | Hinz et al. | 417/393 |
| 4,493,435 | 1/1985 | Hartley . | |
| 4,610,192 | 9/1986 | Hartley et al. . | |
| 4,634,350 | 1/1987 | Credle, Jr. | 417/393 |
| 4,684,332 | 8/1987 | Hartley et al. . | |
| 4,827,831 | 5/1989 | Hartley et al. . | |
| 4,827,832 | 5/1989 | Hartley et al. . | |
| 4,836,924 | 6/1989 | Solomon . | |
| 4,923,168 | 5/1990 | Murata et al. . | |
| 4,927,335 | 5/1990 | Pensa | 417/393 |
| 5,000,845 | 3/1991 | Solomon . | |
| 5,009,777 | 4/1991 | Solomon . | |
| 5,120,202 | 6/1992 | Murata et al. . | |

OTHER PUBLICATIONS

Flojet Corporation, Installation, operation & service instructions for Model 5000 Beverage Pump.

*Primary Examiner*—Richard A. Bertsch
*Assistant Examiner*—Charles G. Freay
*Attorney, Agent, or Firm*—Frank J. Uxa

[57] ABSTRACT

A fluid pumping system comprises a reciprocable pump having a reciprocable member. A valving system controls the supply of fluid under pressure to the reciprocable member to bring about reciprocation of the member. In order to provide a much more compact unit, the valving system is arranged to be offset radially from the reciprocable member, yet is drivingly connected to the reciprocable member through a unique mechanism so that the valving system may switch states responsive to the stroke travel of the reciprocable member.

15 Claims, 7 Drawing Sheets

2A
2A
25
39
41
43
45
47
49
51
53
55
57
59
61
63
65
67
69
71
73
74
75
76
77
78
79
80
81
82
84
87
91
93
107
117
119
121
123
127
129
130
131
133
135
141
145
187
193
195
197
199
201
203
205

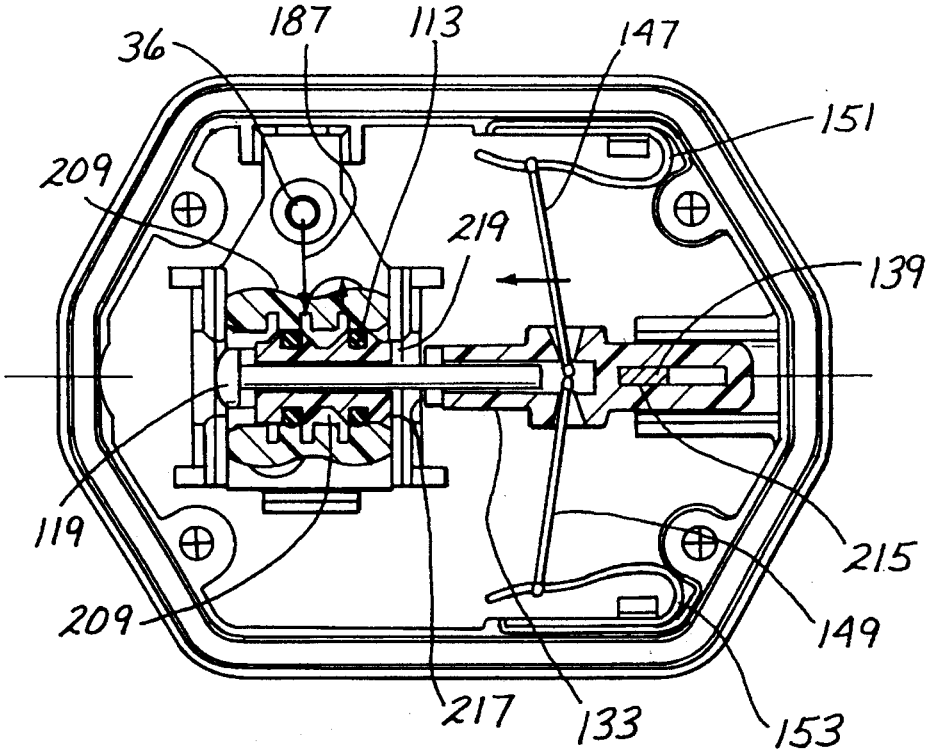
Fig. 3A
Fig. 3B
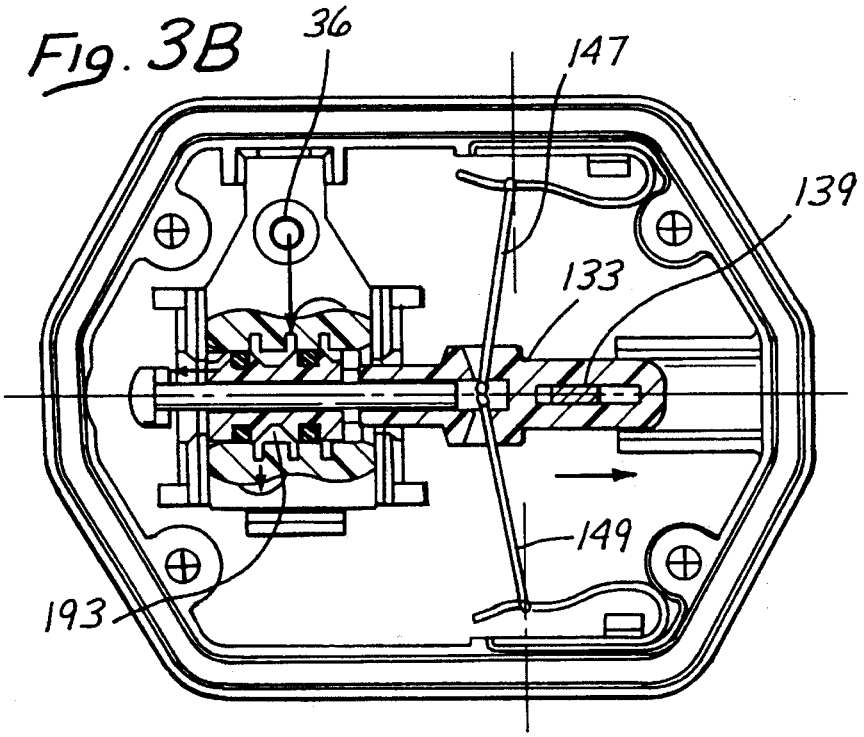

OFFSET RECIPROCABLE DEVICE

BACKGROUND OF THE INVENTION

This invention relates to fluid pumping systems, and more particularly to a beverage pumping system including a reciprocable pumping device having an improved valving system for ensuring dependable switching of the reciprocable member travel direction during operation, wherein the valving system is radially offset from the reciprocable member in order to obtain a more compact housing package.

Fluid pumping systems of the type disclosed in this application typically comprise a source of pumping fluid, such as beverage syrup in a soda fountain system or the like, and a pump. The pump typically includes a reciprocable member which reciprocates to pressurize the pumping fluid. A driving fluid under pressure, which may be either a liquid or a gas, is commonly used to reciprocate the reciprocable member. For example, the reciprocable member may be a piston having first and second faces which are alternately exposable to driving fluid under pressure and to exhaust.

A valve or valving system is provided for controlling the exposure of the piston faces to the pressurized driving fluid and to exhaust. In order for the valve system to perform its function, it typically includes one or more valve elements which must be moved periodically from one position to another to bring about reciprocation of the piston. The reciprocable member and the valving system are typically axially arranged in prior art systems, and movement of the reciprocable member can be used to control movement of the valve elements. In an axial arrangement of the reciprocable member and the valving system, the resulting pump package may be too bulky for certain applications. Therefore, what is needed for these applications is a way to differently configure the pump and valve arrangement so that it can be more compactly packaged.

Yet another element provided in prior art fluid pumping systems wherein the pump is reciprocatingly driven by a pressurized driving gas is a shut-off valve in the conduit between the source of driving gas and the pump. The shut-off valve ensures that should the supply of pumping fluid be interrupted, the supply of driving gas to the pump will be immediately interrupted as well, to prevent potentially damaging dry operation of the pumping system. Typical prior art valves are of the plunger valve type, and are designed to quickly close in response to the sudden drop in line pressure attendant to a cessation in the supply of pumping fluid. The problem is that the prior art valves, because of their design, are not always as stable as they should be. Occasionally, for example, when the pumping fluid supply is interrupted for a relatively long period of time, air may leak into the pumping fluid line. This air, which increases the line pressure above a vacuum level, may increase it sufficiently to cause the shut-off valve to open, thereby activating the pump under dry conditions and possibly damaging it.

SUMMARY OF THE INVENTION

This invention provides a fluid pumping system, particularly for beverage syrup such as that used for soda fountains or the like, which has many desirable features and operates simply and reliably. Because of the inventive features disclosed herein, the pump package is much more compact than prior art packages, and the shut-off valve is very stable and reliable.

The system comprises a reciprocable device, such as a pump, which includes a housing enclosing a chamber therein and a reciprocable member, such as a piston, having first and second faces exposable to a driving fluid under pressure to reciprocate the reciprocable member in the chamber. Also included is a valving system, which in the preferred embodiment comprises a spool valve, for controlling the supply and exhaust of the driving fluid under pressure to and from the first and second faces, whereby the reciprocable member, rather than being axially aligned therewith, is radially offset from the valving system, thus permitting the pump system to be more compactly packaged.

More specifically, the reciprocable member or piston is arranged to reciprocate along a first longitudinal axis, while the valving system is arranged along a second longitudinal axis, preferably substantially parallel to the first axis. A mechanism for drivingly coupling the reciprocable member and the valving system, so that the reciprocable member can actuate the valving system to switch between first and second states, includes an arm member which extends generally radially between the reciprocable member and the valving system. The arm member is preferably generally dog-leg shaped, having a first portion a ranged generally orthogonally with respect to one of the longitudinal axes, and a second portion canted at an angle with respect to the first portion. A valve actuator, including a bistable spring device, is also arranged axially with the valving system, to switch the valving system between its two states. This arrangement is advantageous in providing a more compact design which is structurally simple and reliable.

An important feature of the invention is that the mechanism for drivingly coupling the reciprocable member and the valving system comprises an inside pickup mechanism. More specifically, the reciprocable member comprises first and second reciprocable sections fixedly spaced on a shaft, wherein each of the reciprocable sections has an outer face exposable to the driving fluid under pressure to reciprocate the reciprocable member in the chamber, and also has an inner face. The inside pickup mechanism is driven by the inner faces and preferably includes an element oriented in the space between the first and second reciprocable section inner faces. This element is positioned to be alternately contacted by each of the faces as the reciprocable member reciprocates in the housing chamber. The mechanism element, preferably a follower shaft, initiates the actuation of the valving system between its first and second states, responsive to the alternate contacts by the reciprocable section inner faces. The above described radially oriented arm member is arranged to drivingly couple the follower shaft and the valving system.

Yet another important feature of the invention is related to a driving gas shut-off valve design which ensures a greater stability of the valve, thereby better preventing operation of the pump when the syrup supply is depleted. The fluid pumping system comprises a pump driven by pressurized gas, a first conduit for connecting a pumping fluid supply source to a pumping fluid inlet in the pump, and a second conduit for connecting a pressurized driving gas supply source to a driving gas inlet in the pump. A shut-off valve is provided in the second conduit. The purpose of the valve is to open the second conduit when there is sufficient pumping fluid available for pumping through the first conduit, thereby permitting driving gas to flow through the second conduit to drive the pump, and further to close the second conduit when there is insufficient pumping fluid available for pumping through the first conduit, so that the pump does not operate in a dry intake condition. Importantly, the shut-off valve is configured to open at a first higher pressure in the first conduit and to close at a second lower pressure therein. This feature, which greatly reduces the possibility of pump activation in the absence of actual substantial syrup flow through the first conduit, is attained by establishing a differential area ratio across the shut-off valve sealing surface (preferably an o-ring), which is adapted to be sealingly engaged with a valve seat when the valve is in its closed position, such that the area across which upstream pressure acts against the sealing surface is larger than the area across which downstream pressure acts against the sealing surface. The preferred manner of attaining the desired differential area ratio is to cant the valve seat, so that it is oriented at an angle with respect to a longitudinal axis along which the spool valve body is oriented.

The invention, together with additional features and advantages thereof, may best be understood by reference to the following description taken in connection with the accompanying illustrative drawing.

BRIEF DESCRIPTION OF THE DRAWING

FIG. 3A is a sectional view along lines 3A—3A of the reciprocable device illustrated in FIG. 3, showing the spool valve in its rightward axial position;

FIG. 3B is an axial sectional view similar to that of FIG. 3A, showing the actuation of the bistable device to move the spool valve back to its leftward axial position;

DESCRIPTION OF THE PREFERRED EMBODIMENT

Figure 1:
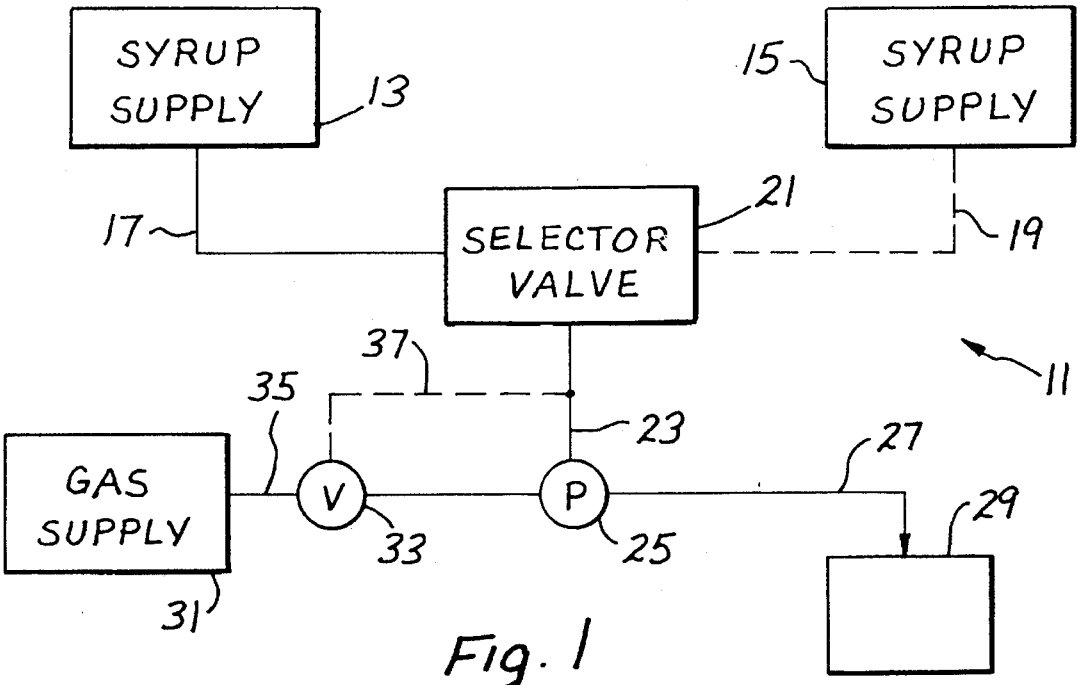
FIG. 1 is a schematic diagrammatic view of one fluid pumping system including a reciprocable device constructed in accordance with the invention.

Referring now to FIG. 1, there is illustrated a liquid pumping system 11, preferably for a beverage dispenser such as a soda fountain, wherein syrup for each type of soda is pumped to the dispenser to be mixed in predetermined ratios with carbonated water prior to being dispensed into a cup or pitcher. Such a system typically includes two or more containers of soft drink syrup 13 and 15, preferably of the bag-in-a-box type, which can be fed through respective conduits 17 and 19 to a selector valve 21. Conduit 19 is represented by a broken line in FIG. 1 to represent the fact that at the instant shown, the selector valve 21 has selected container 13 to dispense beverage syrup through the conduit 17, the valve 21, and a conduit 23 from which it enters a reciprocable device or pump 25. Conduit 19 is therefore shut off.

After a certain period of time during which syrup is pumped from the container 13, as shown, the supply of syrup in that container will begin to be exhausted. Consequently, in order to ensure uninterrupted operation of the soda fountain for the convenience of restaurant patrons, it is desirable to switch the system so that it draws syrup from the other container 15. The selector valve 21, which is conventional and may comprise any known type of valve capable of switching fluid flow between two conduits, may be actuated manually or, preferably, may be actuated automatically responsive to the pressure drop seen at the exit of the container 13 as the syrup supply is depleted.

The beverage syrup flowing from valve 21 through the conduit 23 enters the pump 25, by which it is pressurized, and is then dispensed through a conduit 27 to the fountain dispenser 29. The pump 25 is a gas-driven reciprocable pump which is driven by pressurized gas from a gas supply 31.

At some juncture, should the non-selected syrup container 13, 15 not be refilled while the other one is being emptied, both of the containers will become empty, and the system 11 will be unable to continue operation. It is desirable in such an instance to immediately shut down the pump 25, so that the system is not damaged by attempting to pump air therethrough, as well as to prevent the fountain from dispensing inferior quality beverages, having an incorrect ratio of syrup to water. For this purpose, a shut-off valve 33 is provided in a conduit 35 connecting the gas supply 31 to the pump 25 through a pump gas inlet 36 (FIG. 2A). In the preferred embodiment, the shut-off valve 33 comprises a component of the pump 25 at the pump gas inlet 36, though of course it may also be a separate component, if desired. A control line 37 interconnects the shut-off valve 33 to the conduit 23 between the selector valve 21 and the pump 25. When the pump 25 begins to draw air through the selector valve 21 from both of the empty containers 13 and 15, reducing the line pressure in the conduit 23, the resultant vacuum is detected by the shut-off valve 33 through the control line 37. The shut-off valve is thus actuated to shut off flow through the conduit 35, in a manner more fully described hereinbelow, so that the supply of pressurized gas is cut off from the pump 25, thereby almost immediately causing the pump to cease operation until the supply of syrup can be replenished.

Figure 6:
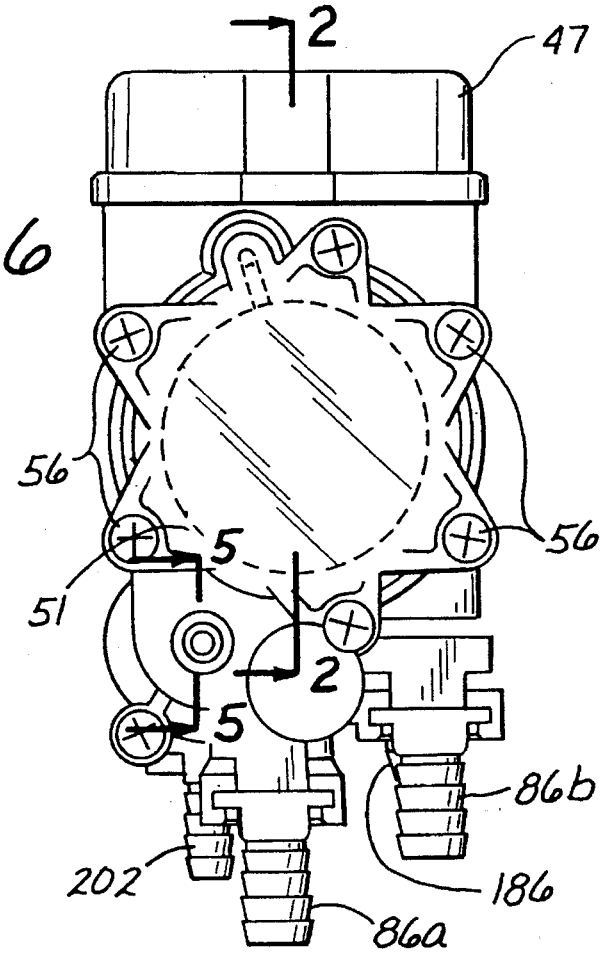
FIG. 6 is an end view of the reciprocable device constructed in accordance with the invention.

Now referring more particularly to FIGS. 2, 2A, 2B, and 6, the pump 25 is illustrated in greater detail. A pump housing 39, comprising a main body portion 41 and left and right end caps 43 and 45, respectively, enclose the pump. A top cap 47 encloses a spool valve 49, which controls the flow of pressurized driving gas alternately to first and second driving chambers 51 and 53, respectively, in order to reciprocate a reciprocable member 55. The end and top caps are fastened to the main body portion 41 by any known means, such as, for example, by threaded fasteners or screws 56, as shown in FIG. 6. The left end cap 43 encloses the first driving chamber 51, while the right end cap 45 encloses the second driving chamber 53.

Figure 4:
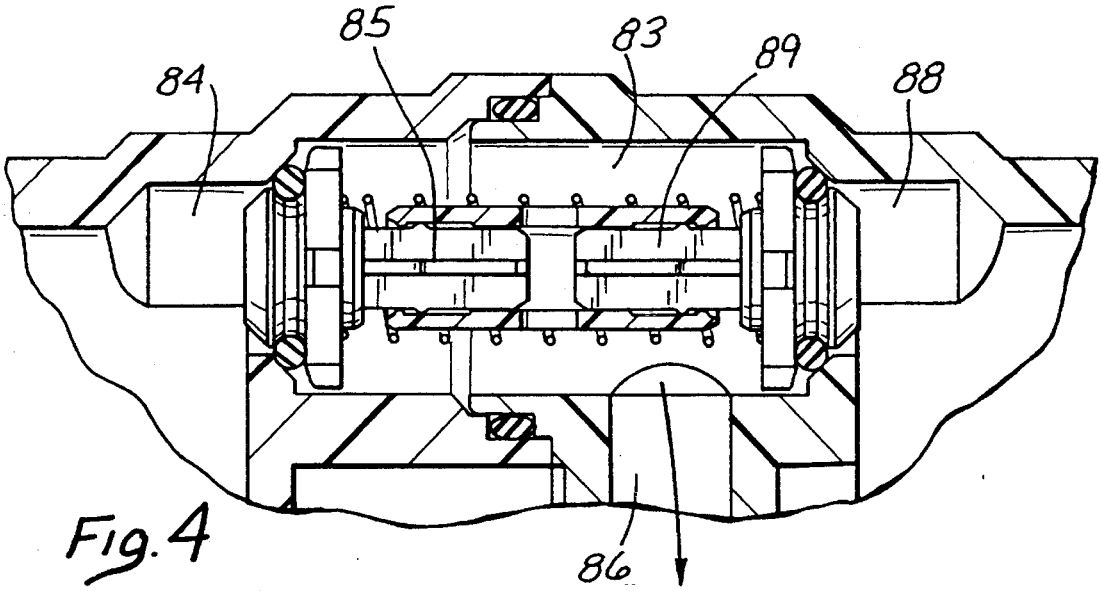
FIG. 4 is an enlarged fragmentary sectional view of pumping chamber outlet valves for the reciprocable device.

The reciprocable member 55 preferably comprises a piston, though it could also comprise a diaphragm, bellows, or the like. The piston 55 is slidably mounted for reciprocating movement along a first longitudinal axis 57, within a chamber 59 defined by the housing 39. Although the piston 55 can be of different constructions, in the form illustrated, it includes piston sections 61 and 63 joined together by a shaft 65 and having driving faces 67 and 69 and pumping faces 71 and 73. Annular rolling diaphragms 74 and 75 seal the interfaces between the main pump body 41 and the end caps 43 and 45, respectively, and form a seal between the housing 39 and the associated piston sections 61 and 63. The piston shaft 65 is coupled to piston sections 76 and 77 and is mounted for axial sliding movement in a double shaft seal 78. This arrangement provides the aforementioned driving chambers 51 and 53 at the opposite ends of the piston 55 and sealed pumping chambers 79 and 80 between the piston sections 61 and 63. The pumping chambers 79 and 80 are sealed from each other by suitable structure, including a partition 81 of the housing 39. The partition 81 encloses a pair of pumping fluid inlet and outlet chambers 82 (FIG. 2) and 83 (FIG. 4), respectively, and carries the seal 82.

The spool valve 49 controls the supply of driving fluid under pressure from the supply source 31 to the driving chambers 51 and 53, as noted above, and also controls the exhausting of the driving chambers to atmosphere or other place of reduced pressure. By properly operating the spool valve 49 between at least a first and a second position, the piston 55 is reciprocated in the chamber 59.

Figure 2:
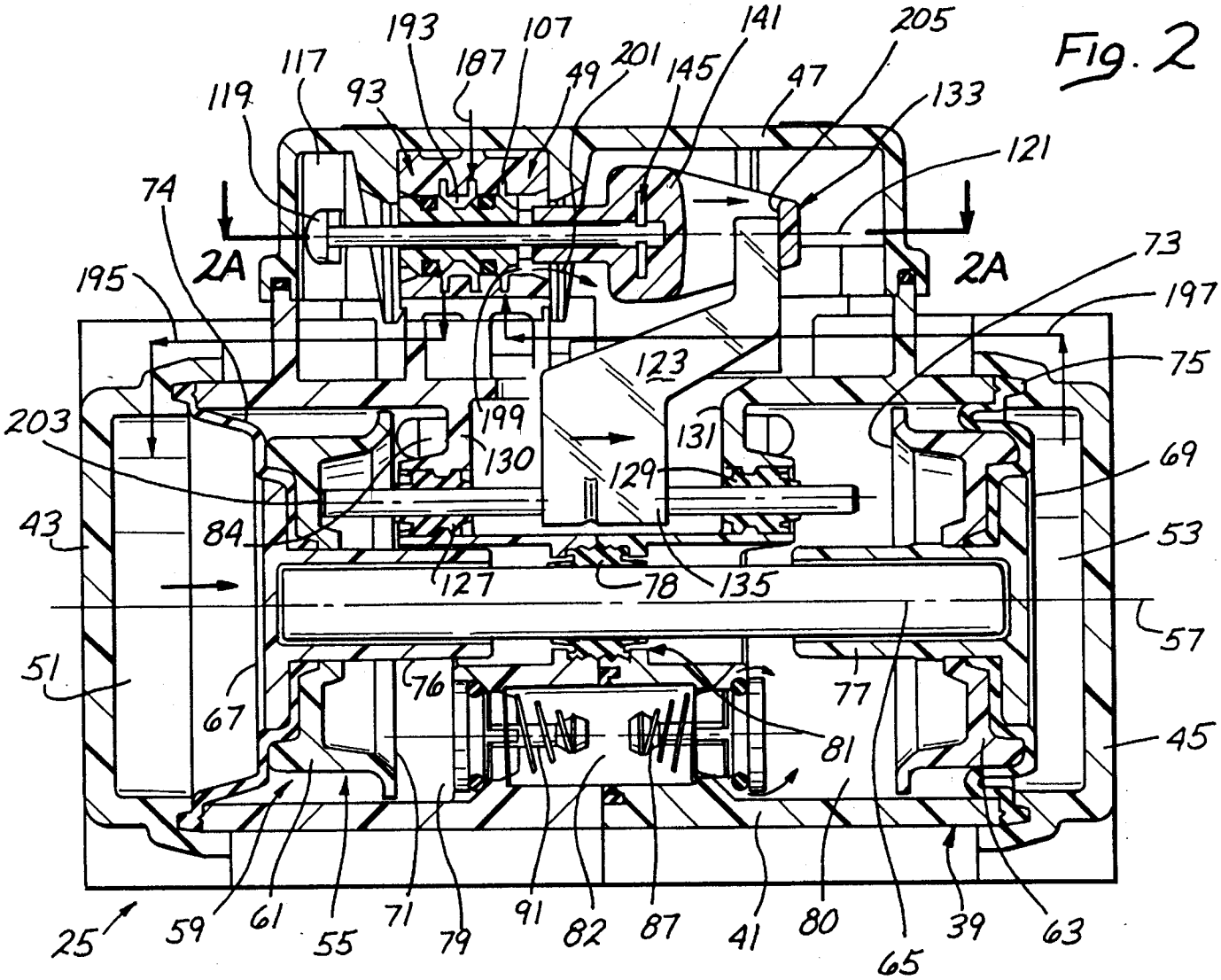
FIG. 2 is an axial sectional view of a reciprocable device constructed in accordance with the invention, taken generally along lines 2—2 of FIG. 6 and illustrating a reciprocable pumping member moving toward the right and a radially offset spool valve, with certain elements not forming a part of the invention removed for clarity.
Figure 2A:
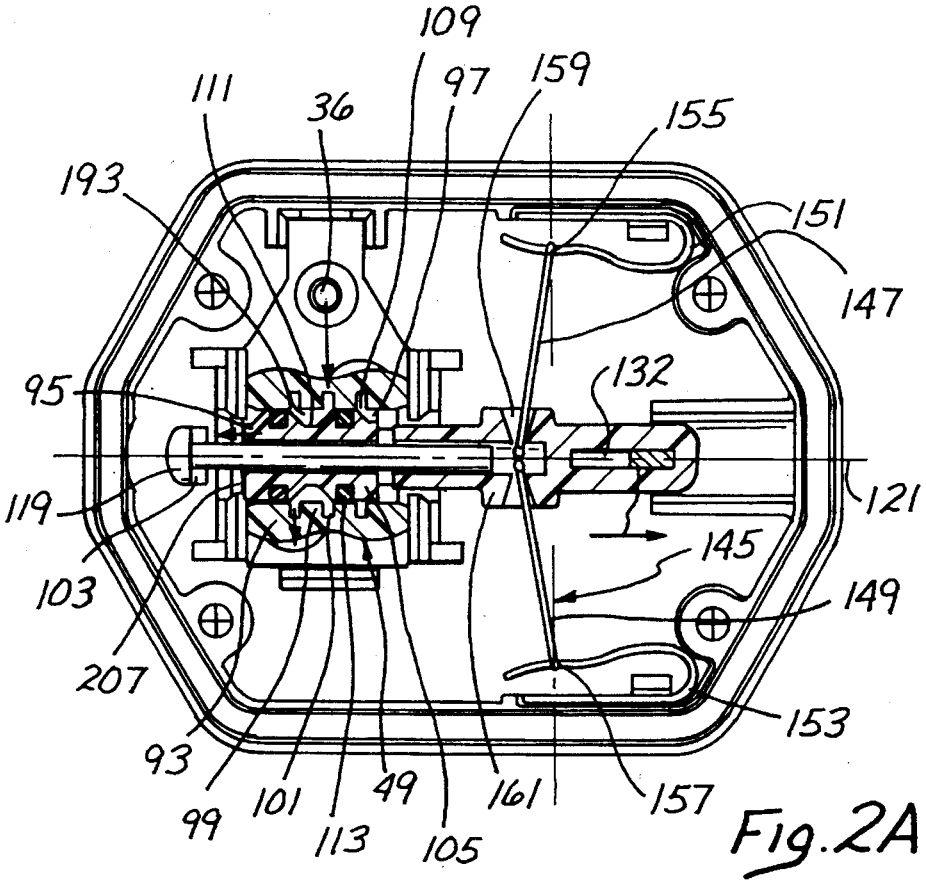
FIG. 2A is a sectional view along lines 2A—2A of the reciprocable device illustrated in FIG. 2, showing the spool valve in one of its two axial positions.
Figure 3:
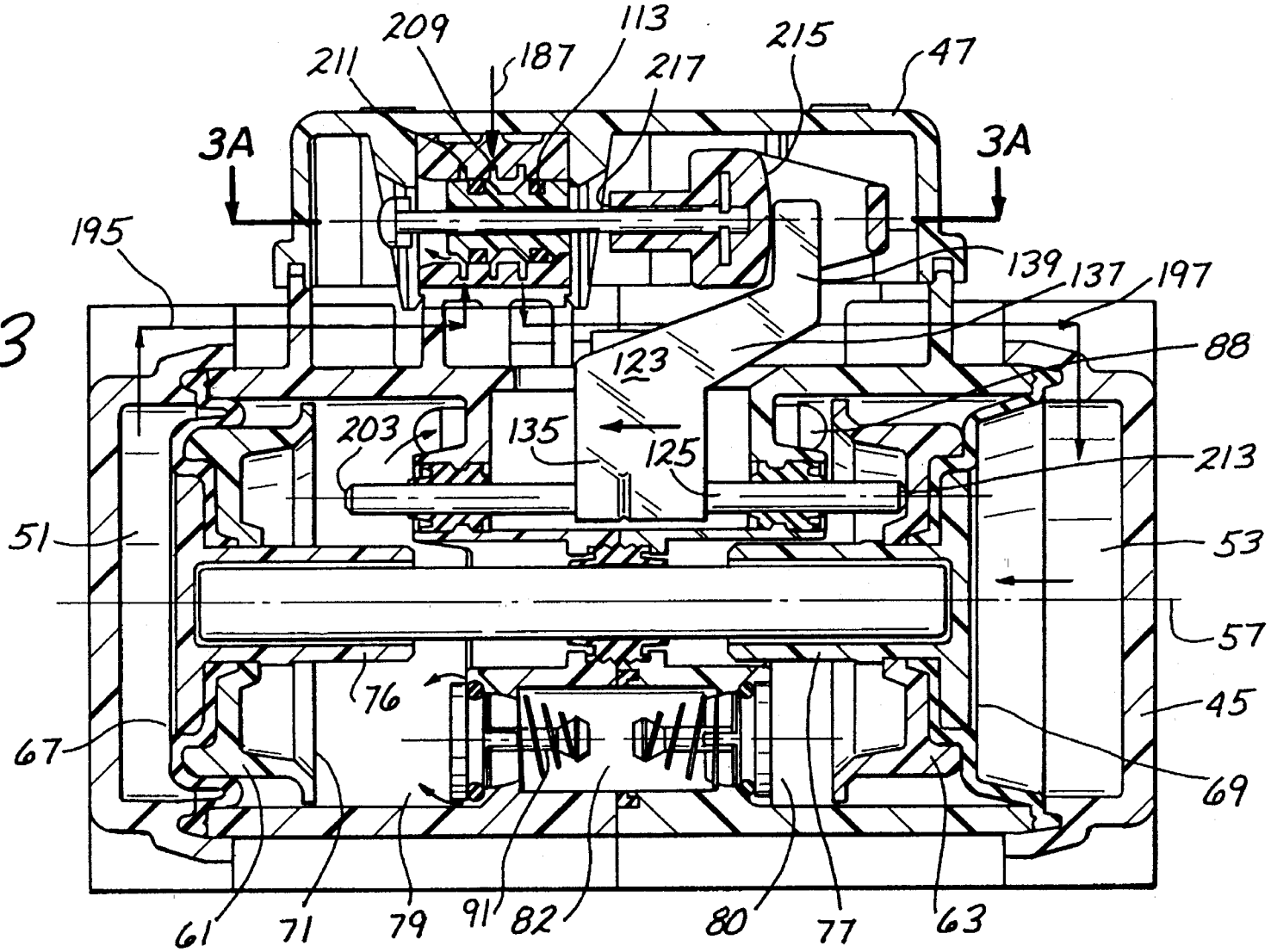
FIG. 3 is an axial sectional view similar to that of FIG. 2, showing the reciprocable member moving toward the left.

As the piston 55 moves rightwardly, as shown in FIG. 2, the beverage syrup in the pumping chamber 79 is forced by the pumping face 71 of the piston section 61 to exit the chamber through an outlet 84 (FIGS. 2 and 4) and a check valve 85 into the pumping fluid outlet chamber 83. The construction of the check valve 85 and the outlet chamber 83 is shown more clearly in FIG. 4. From the outlet chamber 83, the pressurized syrup flows through an exit passage 86 and an outlet nipple **86*a* (FIG. 6) into the conduit 27 (FIG. 1), from whence it flows into the dispenser 29. Meanwhile, as the pumping fluid or syrup exits from the pumping chamber 79, syrup is simultaneously drawn into the pumping chamber 80 from the inlet conduit 23, serially flowing through an inlet nipple 86*b* (FIG. 6), the inlet chamber 82 and an inlet check valve 87 (FIG. 2). When the piston 55 reverses direction, as shown in FIG. 3, and begins to travel leftwardly, the syrup in the pumping chamber 80 is forced by the piston section 63 through a second outlet 88 and a second outlet check valve 89 (FIGS. 3 and 4) into the outlet chamber 83, from which it flows into the exit passage 86 and through the outlet nipple 86*a*, as described above. Syrup is simultaneously drawn into the pumping chamber 79 through a second inlet check valve 91 from the inlet chamber 82. The effect as the piston 55 reciprocates back and forth is that a substantially pulseless flow of pressurized syrup is available to the fountain dispenser 29** for optimum operation.

Referring again to FIG. 2, 2A, and 2B, the spool valve 49 comprises a valve housing 93 having an inner wall surface 95 which defines a generally cylindrical valve chamber 97. The inner wall surface 95 of the valve housing 93 is comprised of a series of alternating annular lands 99 and annular undercuts or grooves 101. Slidably mounted axially about a rod 103 within the valve chamber 97 is a spool valve body 105 which has an exterior surface 107 formed of an alternating series of annular lands 109 and grooves 111. Retained in channels on the valve body lands 109 are a plurality of o-rings 113, which are oriented so that when the valve body 105 is stopped in a position wherein the valve housing lands 99 and the valve body lands 109 are aligned, each land 99 is in sealing engagement with a respective o-ring 113. The rod 103 may move axially independently of the valve body 105. The rod 103 extends leftwardly out of the valve chamber 97 into a space 117, which in the preferred embodiment comprises an exhaust plenum for the spent driving fluid. On the leftmost side of the rod 103 is threadedly mounted a bumper nut 119 for a purpose which is described more fully hereinbelow.

A unique and important feature of this invention is its compact configuration, which is made possible because the spool valve 49 is arranged along a second longitudinal axis 121 which is radially offset and spaced from the first longitudinal axis 57, and preferably substantially parallel thereto. An offset attachment arm 123 is fixedly mounted on a follower shaft 125, which in turn is journalled within a pair of elastomeric bearings 127 and 129. The bearings 127 and 129 are mounted on a pair of pump housing flange portions 130 and 131, respectively, which may form part of the partition 81. The arm 123 extends upwardly through an access aperture 132 in the pump housing 39 and into the space enclosed by the top cap 47, wherein it is interconnected with the valve rod 103 by means of a valve actuator 133. The attachment arm 123 is dog-leg shaped, with a first portion 135 arranged generally perpendicularly with respect to both of the axes 57 and 121, and a second portion 137 canted at an acute angle with respect to the first portion 135 so that the reciprocable pump device can be more compactly packaged. A third portion 139 is again arranged generally perpendicularly with respect to the axes 57 and 121. Of course, as many arm portions as desired may be employed so that the attachment arm 123 may be configured in any manner necessary to permit the desired pump housing configuration.

Figure 2B:
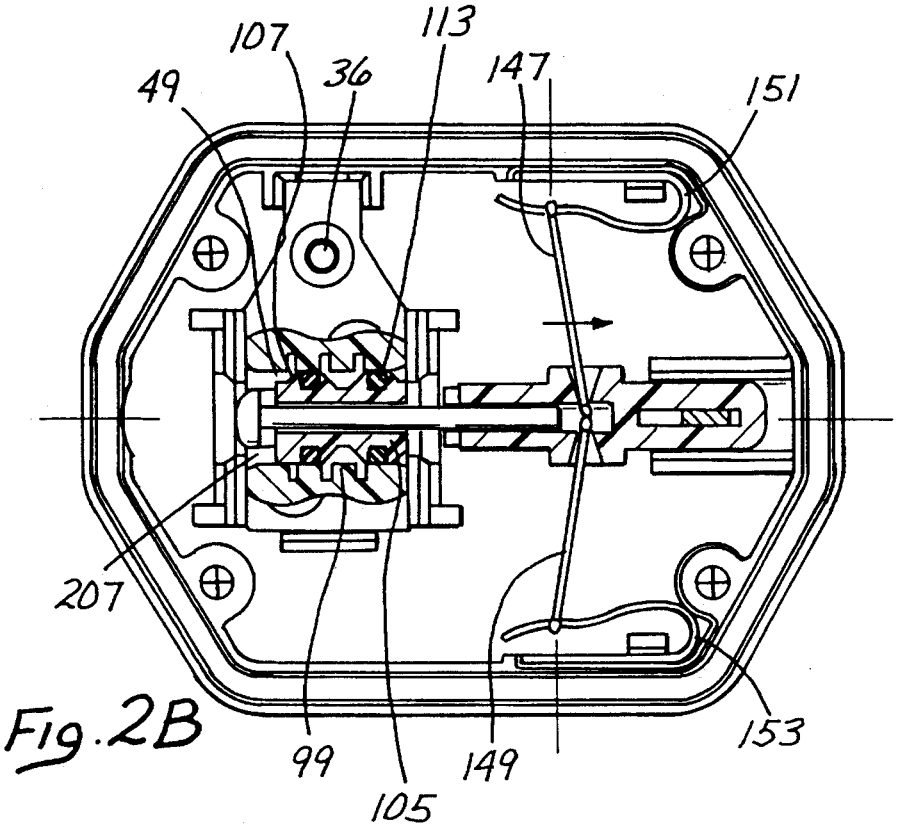
FIG. 2B is a sectional view similar to that of FIG. 2A, showing the actuation of a bistable spring device to move the spool valve rightwardly into its other axial position.

Still viewing FIGS. 2, 2A, and 2B, the valve actuator 133 comprises a coupling portion 141, which includes a lost motion chamber 143 into which the third portion 139 of the attachment arm 123 extends. Leftwardly of the lost motion chamber 143 is a bistable spring device 145, which comprises identical rigid levers 147 and 149 (FIGS. 2A and 2B). The levers 147 and 149 are preferably constructed of stainless steel. The bistable spring device 145 further comprises identical U-shaped springs 151 and 153, which are attached to the top cap 47. The levers 147 and 149 have tabs 155 and 157 on the outer ends thereof, which are received by openings (not shown) in the U-shaped springs 151 and 153, thereby attaching the levers 147 and 149 to the springs 151 and 153 so that the levers are biased towards the coupling portion 141. Such an attachment scheme is shown and disclosed in U.S. Pat. No. 4,610,192, herein incorporated by reference. Of course, other well known prior art attachment methods may be utilized equally well without compromising the efficacy of the claimed invention. The springs 151 and 153 may be integrated into one spring, interconnected by a web such as that shown in the U.S. Pat. No. 4,610,192 patent, or may be distinct spring elements, as shown. The coupling portion 141 has recesses 159 and 161, which progressively widen as they extend radially toward the periphery of the coupling portion 141 and this allows each of the levers to pivot about a pivot axis at the inner end of the associated recess. Because the levers 147, 149 are biased toward the coupling portion 141, it forms pivot axes for the levers by virtue of the progressively widening nature of each of the recesses 159 and 161.

Figure 5:
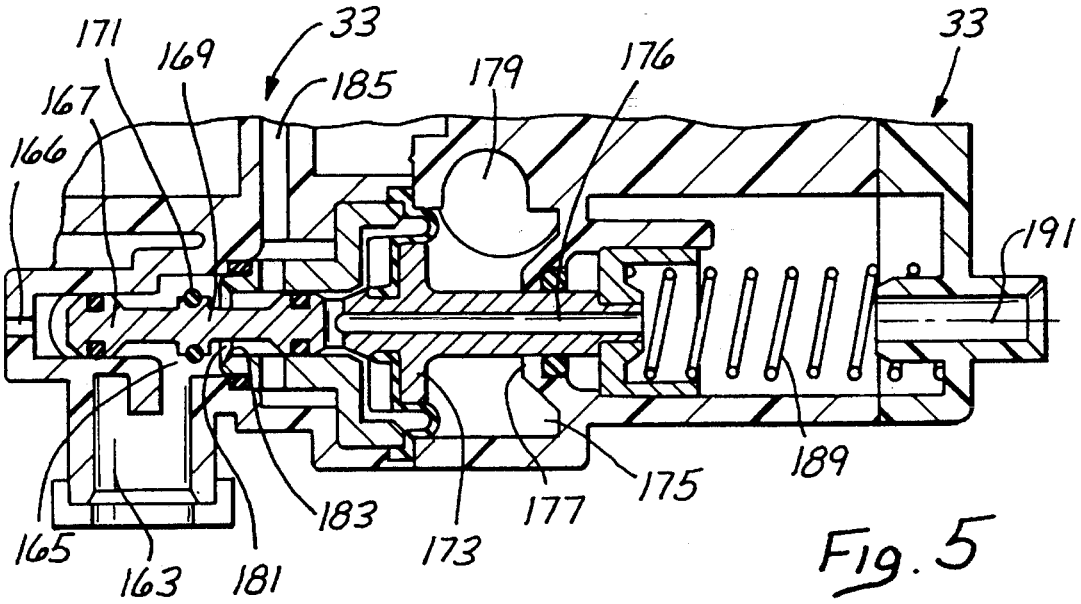
FIG. 5 is a sectional view along lines 5—5 of FIG. 6, showing the driving gas shut-off valve illustrated schematically in FIG. 1.
Figure 5A:
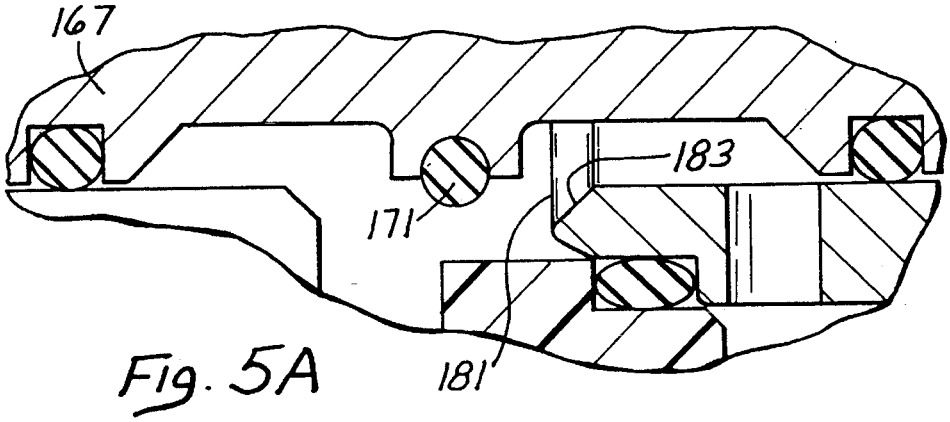
FIG. 5A is an enlarged fragmentary sectional view of a portion of the gas shut-off valve illustrated in FIG. 5.

Referring now to FIGS. 1, 5, 5A, 5B, and 5C in particular, yet another important aspect of the invention is illustrated. The shut-off valve 33, which shuts off the pressurized gas flow from the gas supply 31 when the syrup supply becomes exhausted, is shown in detail in FIG. 5. Pressurized gas from the gas supply conduit 35 enters the valve 33 via an inlet passage 163. The shut-off valve 33 is of the plunger type. The pressurized gas enters a valve chamber 165 from the inlet 163, and the housing is vented by a vent 166 at its left end. A plunger valve body 167 is slidable axially within the valve chamber 165, and includes a plurality of lands 169 and sealing surfaces or o-rings 171 positioned on the lands 169. A reciprocable member or piston 173, which in this embodiment includes a diaphragm, is axially aligned with and integral with the valve body 167, so that as the piston 173 reciprocates within a piston chamber the valve body 167 is actuated to slide axially between its open and closed positions. A vent passage 176 extends through the piston 173 as shown in FIG. 5. Between the piston 173 and a distal piston chamber wall 177 is a tap 179 which detects the syrup pressure in the conduit 23 through the control line 37 (FIG. 1). Under ordinary operating conditions, when syrup is available to flow through the conduit 23 into the pump 25, a spring 189 resiliently holds the valve body 167 in its open position. Under these conditions the vacuum syrup pressure at the tap 179 from the intake side of the pump will be insufficient to overcome the spring 189 and close the valve. When the valve is open, pressurized gas is permitted to flow from the inlet 163 through a gap 181 between one of the o-rings 171 and a conically shaped valve seat 183, as shown most clearly in FIG. 5A. It then flows through an exit passage 185 (FIG. 5) back into the conduit 35 between the valve 33 and the pump 25 from whence the pressurized gas enters the pump via a gas inlet nipple 186, flowing into the spool valve 49 through a pump driving gas inlet conduit 187 (schematically illustrated in FIG. 3).

Figure 5B:
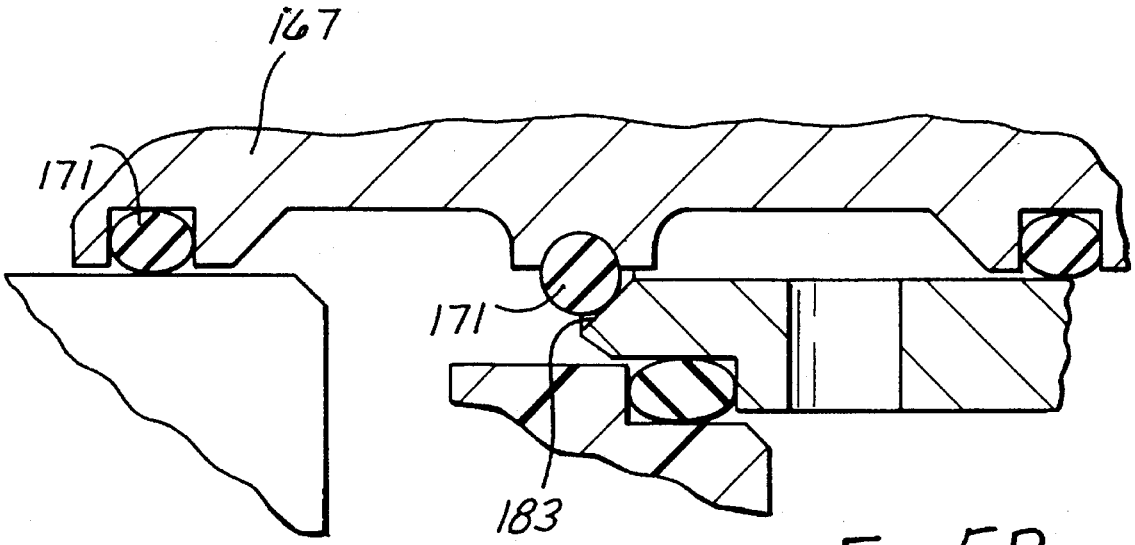
FIG. 5B is an enlarged fragmentary sectional view similar to FIG. 5A, showing the gas shut-off valve in the closed position.

However, when the supply of syrup is exhausted, it is desirable to immediately cease supplying pressurized gas through conduit 35 to drive the reciprocable pump 25. Consequently, when the tap 179 sees a significant drop in pressure, via the control line 37, because of a higher vacuum pressure condition, the pressure in the piston chamber 175 drops sufficiently to pull the piston 173 to the right, thereby overcoming the biasing spring 189. This pulls the valve body 167 to the right, until the o-ring 171 seats against the valve seat 183, as shown in FIG. 5B, thereby closing the gap 181 and preventing the flow of pressurized gas to the exit passage 185.

Figure 5C:
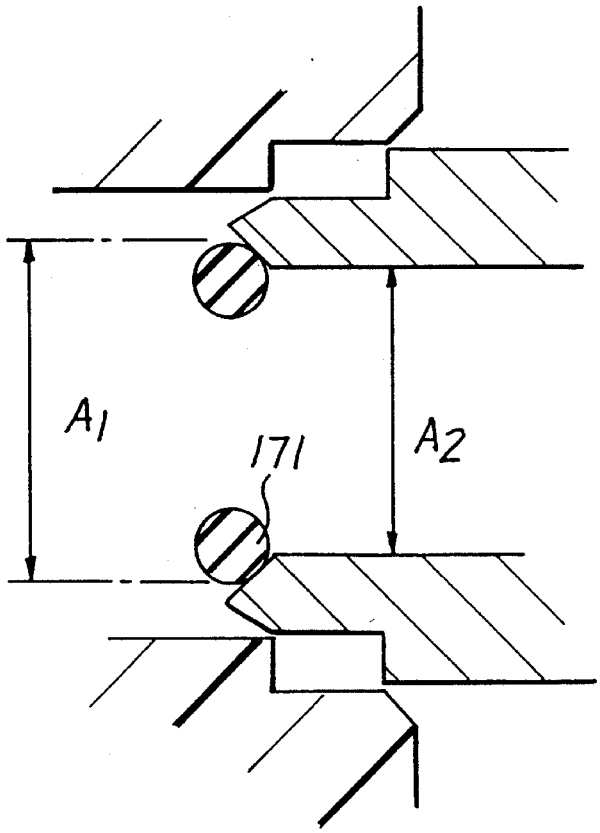
FIG. 5C is a diagrammatic view, partially in section, of the gas shut-off valve in the closed position, with certain elements deleted in order to more clearly illustrate an important operating principle of the invention.

A unique and important feature of the invention is that the valve seat 183 is conical, i.e. oriented at an acute angle to an axis 191 along which the valve body 167 and piston 173 are oriented. Referring now to FIG. 5C, which illustrates the valve 33 in the closed position, with certain elements omitted for clarity, it can be seen that because of the conical valve seat, a differential area ratio is established between area $A_1$, across which upstream pressure $P_1$ acts, and area $A_2$, across which downstream pressure $P_2$ acts from the opposite direction. This differential area ratio, in which the valve seat is typically generally coaxial with the valve body, is particularly advantageous because it results in a much more stable valve than those typically utilized in the prior art. The reason for this stability is that, since the area $A_1$ is substantially larger than the area $A_2$, when the pressures $P_1$ and $P_2$ are equal and the valve is closed, there will be a net fluid force on the land 169 and the o-ring 171 in the closure direction, because the pressure $P_1$ is acting across a larger area than the pressure $P_2$. This net fluid force does not exist when the valve is open. Consequently, it takes a higher pressure at the tap 179 to open the valve than to close it. This is important, particularly when the syrup supply in containers 13 and 15 is dry for a lengthy time period, because air often leaks into the system over time. This air increases the pressure in the supply line 23 to a certain extent, and in some instances that increased pressure is sufficient to cause the shut-off valve to open in prior art systems, thereby actuating the pump under dry conditions. However, the inventive system, with its conical valve seat, differential pressure ratio, and resultant improved stability, is not fooled into activation by the relatively small tap pressure increase created by such air leakage.

Now with reference to the operation of the disclosed syrup pumping system, it is first assumed that there is an adequate supply of pumping fluid or syrup in at least one of the containers 13 and 15, and that the selector valve 21 has already selected one of the containers to supply syrup to the pump 25 via inlet conduit 23. It is also assumed that all of the pumping fluid passages have already been fully primed. Since there is an adequate syrup pressure in the conduit 23, i.e. the vacuum pressure at the intake of the pump 25 is not too high, the spring 189 holds the valve body 167 open and permits pressurized driving gas to flow through the valve 33 into the pump 25 via the gas inlet nipple 186, in the manner described above.

Driving gas enters the pump 25 via the inlet nipple 186 and conduit 187 into a first annular chamber portion 193 of the spool valve 49 (FIGS. 2 and 2A). The spool valve body 105 is in a first position at this juncture, permitting the fluid to exit the chamber portion 193 via a fluid conduit 195 (FIG. 2) which communicates with the first driving chamber 51. The influx of pressurized driving fluid into the driving chamber 51 drives the piston 55 to the right, thereby causing pressurized syrup to exit the left pumping chamber 79 through the outlet check valve 85 and the driving fluid to be exhausted from the driving chamber 53 through an exit fluid conduit 197 shown schematically in FIG. 2. The exhaust conduit 197 communicates with a second annular chamber portion 199 (FIG. 2) of the spool valve 49. From the annular chamber portion 199, the exhaust fluid flows through an exhaust passage 201 and then through a gas outlet nipple 202 to atmosphere, a waste sump, or some other low pressure application. As the piston 55 moves toward the right, the pumping face 71 of the piston section 61 contacts a left end surface 203 (FIG. 2) of the follower shaft 125 and pushes the shaft to the right so that the offset attachment arm moves to the right in conjunction with the shaft 125. Consequently, the third arm portion 139 moves rightwardly through the lost motion chamber 143, until it contacts a lost motion chamber wall surface 205. This contact pushes the valve actuator 133 to the right, thereby pulling the levers 147 and 149 of the bistable spring device 145 to the right so that they pivot from a first position wherein they are pivoted to the left, as shown in FIG. 2A, through a neutral position and over center.

As the levers 147 and 149 pivot over center, the resilience of the springs 151 and 153 rapidly forces the levers farther over center and into their second position, pivoted to the right, as shown in FIG. 2B. This rapid movement of the levers 147 and 149 becomes stronger as the levers travel farther past the over center point, pushing the valve actuator 133 and the associated valve rod 103 equally rapidly to the right. As the rod 103 moves to the right, the attached bumper 119 moves in conjunction therewith to the right as well, through the space 117, until it contacts the left side 207 of the valve body 105 (shown most clearly in FIGS. 2A and 2B). The force applied to the valve body 105 by the rapid movement of the bumper 119 to the right initiates movement of the valve body rightwardly to its second axial position, as shown in FIG. 2B. The space 117 and the lost motion chamber 143 together ensure that the spool valve 49 is not actuated to its alternate position until the piston 55 has traveled a sufficient distance to permit the reciprocating pump 25 to function properly.

An important aspect of the invention is that the spring biased levers 147 and 149 are arranged to form an over center device, in order to provide the impetus necessary to move the spool valve 49 from one to another of its two positions. However, on occasion, there may be a need for a mechanical backup to ensure the proper operation of the over center device. If for any reason switchover is not initially achieved by the bistable spring device 145, an advantage of the instant invention over the prior art is that the piston itself provides a backup means for ensuring that the bistable device is able to switch the valve to its alternate position. Referring again to FIGS. 2, 2A, and 2B, should the spring device 145, moving from its neutral position to its over center position as disclosed above, fail to initiate movement of the valve 49 from its first to its second position, the piston 55, and the associated valve actuator 133 through the arm 123, will continue to move toward the right, pulling the associated spool valve rod 103 to the right as well. Once the bumper 119 impacts the left side 207 of the valve body 105, the valve body will be forced to slide rightward axially, allowing it to pass the sealing land 99, into the frictionless undercut area, or switching zone, 101. This allows the stored energy of the bistable spring 145 to accelerate the valve body 105 in a frictionless environment towards the other sealing position. Once the valve 49 has been switched, the driving fluid flowpath changes and the piston 49 reverses direction, as is described more fully below.

The movement of the valve body 105 from its first position, shown in FIG. 2A, to its second position, shown in FIG. 2B, constitutes a movement of each of the lands 109 of the valve body a total axial distance equal to the distance between valve chamber lands 99, so that each o-ring 113 aligns in sealing engagement with the land 99 adjacent to the land 99 with which it was previously aligned. Referring now particularly to FIGS. 3, and 3A, the reciprocable pump 25 is shown with the valve 49 in its second position. Consequently, because of the repositioned o-rings 113, the pressurized driving fluid from the supply line 187 is delivered into a different third annular chamber portion 209. The flow conduit 195 into the driving chamber 51 is now shut off from the supply conduit 187 by an intervening o-ring 113, and the driving fluid is now redirected into the fluid conduit 197 which communicates with the other driving chamber 53. The influx of pressurized driving fluid into the driving chamber 53 reverses the travel direction of the piston, driving it to the left, thereby causing pressurized syrup to exit pumping chamber 80 through the second outlet check valve 89 (FIG. 4) and driving fluid to be exhausted from driving chamber 51 through the fluid conduit 195. The conduit 195 communicates with the exhaust plenum 117 through a fourth annular chamber portion 211 of the spool valve 49, as shown in FIGS. 3 and 3A. With the movement of the piston 55 back to the left, the pumping face 73 of the piston section 63 contacts a right end surface 213 of the follower shaft 125 and pushes the shaft to the left, so that the offset attachment arm moves to the left in conjunction with the shaft 125. Consequently, the third arm portion 139 moves leftwardly through the lost motion chamber 143, until it contacts a lost motion chamber wall surface 215. This contact pushes the valve actuator 133 to the left, thereby causing the levers 147 and 149 of the bistable spring device 145 to pivot from their second position wherein they are pivoted to the right as shown in FIG. 3A, to a neutral position and over center. As the levers 147 and 149 pivot over center, the resilience of the springs 151 and 153 rapidly forces the levers farther over center and into their first position, pivoted to the left, as shown in FIG. 3B. This rapid movement of the levers 147 and 149, which becomes stronger as the levers travel farther past the over center point, pushes the valve actuator 133 and the associated valve rod 103 equally rapidly to the left. The valve actuator 133 moves leftwardly responsive to the lever movement described above, until a left end surface 217 contacts the valve body right side 219. This contact initiates movement of the valve body back to the left, to its first position (FIG. 3B). This switching of the valve 49 again changes the driving fluid flow path, to the arrangement shown in FIG. 2, thereby again reversing the piston travel direction and beginning a new cycle.

As discussed with respect to FIG. 2, the spring biased levers 147 and 149 provide the impetus necessary to ensure that the switchover occurs. Referring again to FIGS. 3, 3A, and 3B, should the spring device 145, moving from its neutral position to its over center position, as disclosed above, fail to initiate movement of the valve 49 from its second to its first position, because of a valve jam or the like, the piston 49 will continue to move toward the left, as will the actuator 133, until the left end surface 217 contacts the valve body right side 219. This contact initiates movement of the valve body 105 back to the left, toward the frictionless undercut, or switching zone, 101. This will allow the stored spring energy to be released, which accelerates the valve body 105 in a frictionless environment toward its first position.

As noted above, the left and right pumping faces 71 and 73 of the piston sections 61 and 63, respectively, contact respective ends 203 and 213 of the follower shaft 125 as the piston reciprocates, thereby acting to reciprocate the follower shaft and thus actuate the valving system through the arm 123. This feature, which may be referred to as an "inside pickup" system for driving the valve switching mechanism, because the follower shaft 125 is driven, or "picked up" by the piston 55 from within the area between the piston sections 61 and 63, is advantageous since it permits a much more compact packaging of the pump 25. In contrast, many prior art systems utilize "pickup systems" which extend axially and/or radially from the pump's reciprocable member(s), necessitating a larger, more bulky pump package. Additionally, another advantage of the inside pickup configuration is that the compactness of the design requires less driving gas to operate the pump, because smaller driving chambers 51 and 53 may be used, thereby saving on both cost and driving gas storage requirements.

Yet another key aspect of this invention is the advantageous configuration of the spool valve 49 in that it is hydraulically balanced. In the prior art systems, which use poppet valves to switch the piston travel direction, the valves are biased by the fluid pressure in the system, requiring a larger bistable spring force to overcome the fluid pressure bias in order to switch the valves. Thus, for high pressure applications, a strong spring must be used to assure switching of the valves. This relatively high spring force holds the reciprocable member in either of two positions even when the device is not in use, and as a consequence, the seating surfaces of the valves tend to take an undesirable permanent set. However, in the inventive system, the spool valve 49 is designed to be held in either of its positions merely by virtue of the relatively small spring force created by the bistable spring, which holds the valve body 105 in position prior to initiation of the valve switching process, in order to eliminate the possibility of unintentional switching. The friction developed by the sealing engagement between the o-rings 113 and their corresponding lands 99 also serves as a secondary means for holding the valve body in position. Thus, the bistable spring device 145 need only overcome its own bias and the frictional force to initiate movement of the valve body 105 from one position to another, permitting the use of a less powerful spring.

An additional advantage of the present invention, further reducing the force and the duration of the force necessary to switch the valve, is the use of the fully annular grooves or undercuts 101 to provide the inlet and outlet fluid flow passages for the spool valve 49, rather than simple drilled bores that are typically used in the prior art. The advantage of the annular undercuts is that as the valve body 105 travels axially from one of its positions to the other one, each of the o-rings 113 moving from one land 99 to the next, the o-rings encounter no friction as they travel over the annular undercuts. Therefore, once a sufficient force has been applied to the valve body 105 to overcome the bistable spring bias and the friction due to the sealing engagement between each of the o-rings 113 and its corresponding land 99, thereby initiating motion of the valve body 105, the valve body will have sufficient momentum to travel an axial distance equivalent to the distance between lands 99, and thus sufficient to move into its other position. The virtually frictionless travel of the o-rings across the undercuts 101 will not degrade that momentum.

Although an exemplary embodiment of the invention has been shown and described, many changes, modifications, and substitutions may be made by one having ordinary skill in the art without necessarily departing from the spirit and scope of this invention.

What is claimed:

1. A reciprocable device, comprising:

a housing having a chamber therein;

a reciprocable member in the chamber and having first and second faces exposable to a driving fluid under pressure to reciprocate the reciprocable member in the chamber;

a valving system for controlling the supply and exhaust of the driving fluid under pressure to and from the first and second faces whereby the reciprocable member can be reciprocated in said chamber, said valving system being radially offset from said reciprocable member;

a mechanism for drivingly coupling the reciprocable member and the valving system so that the reciprocable member can actuate the valving system to switch between first and second states, said mechanism including an arm member drivingly coupled to said reciprocable member and to said valving system, said arm member being arranged generally radially between said reciprocable member and said valving system and being generally dog-leg shaped so that said reciprocable device may be more compactly packaged; and said first and second faces being outside faces, the reciprocable member including first and second inside faces and including an inside pickup mechanism driven by said inside faces for operating said valving system.

2. A reciprocable device, comprising:

a housing having a chamber therein;

a reciprocable member in the chamber and having first and second faces exposable to a driving fluid under pressure to reciprocate the reciprocable member within the chamber along a first longitudinal axis;

a spool valve being oriented along a second longitudinal axis for controlling the supply and exhaust of the driving fluid under pressure to and from the first and second faces whereby the reciprocable member can be reciprocated in said chamber, said second longitudinal axis being radially offset from said first longitudinal axis;

a mechanism for drivingly coupling the reciprocable member and the spool valve so that the reciprocable member can actuate the spool valve to switch between first and second states, said mechanism including an arm member having a first end portion drivingly coupled to said reciprocable member and a second end portion drivingly coupled to said spool valve, said arm member being arranged generally radially between said reciprocable member and said spool valve; and a bistable spring device having first and second states and a neutral position between said states thereof, said arm member second end being drivingly coupled to said bistable spring device such that said reciprocable member can move the bistable spring device from one of its states through the neutral position, with the resilience of the bistable spring device at least assisting in moving the bistable spring device from its neutral position to the other state thereof, the movement of the bistable spring device from its neutral position to the other state actuating said spool valve to switch between first and second states.

3. A reciprocable device as recited in claim 2, wherein said arm member includes a first portion arranged generally orthogonally with respect to one of said longitudinal axes, and a second portion canted at an angle with respect to said first portion so that said reciprocable device may be more compactly packaged.

4. A reciprocable device as recited in claim 3, wherein said arm member includes a third portion arranged generally perpendicularly with respect to one of said longitudinal axes, said third portion extending into a lost motion chamber in said valve actuator, such that when said arm member reciprocates axially responsive to reciprocation of said reciprocable member, said third arm member portion travels axially through said lost motion chamber, until contacting an interior end wall of said chamber, after which the contact between said arm member portion and said interior end wall actuates said spool valve axially from one of its operating states to the other one.

5. A reciprocable device as recited in claim 2, wherein said arm member first end portion is fixedly mounted on a follower shaft arranged generally parallel to said first longitudinal axis, said follower shaft being adapted to reciprocate in response to reciprocation of said reciprocable member, thereby reciprocating said arm member to actuate said spool valve.

6. A reciprocable device as recited in claim 5, wherein there is some lost motion between the initiation of travel of said reciprocable member in a certain direction and the initiation of travel of said follower shaft in the same direction responsive thereto, thereby ensuring that said reciprocable member may travel through its entire stroke length before being reversed.

7. A reciprocable device as recited in claim 6, wherein said reciprocable member comprises a piston having first and second piston sections positioned on a pumping shaft, each of said piston sections having an outer gas driving face and an inner pumping face, said follower shaft being journalled between said two piston section pumping faces, such that when said piston reciprocates in a certain direction, one of said inner pumping faces contacts an end of said follower shaft after a predetermined stroke distance constituting said lost motion provision, said contact driving said follower shaft in the same direction of travel as said piston.

8. A reciprocable device as recited in claim 2, wherein said spool valve comprises:

a valve housing having a valve chamber therein, said valve chamber being defined by an interior wall surface having a plurality of lands arranged thereon, and a plurality of undercut annular grooves being arranged in an alternating fashion between said valve chamber lands;

a valve body slidably mounted within said valve chamber, said valve body comprising a generally cylindrical exterior surface having a plurality of lands arranged thereon, said valve body lands being configured to include sealing surfaces which sealingly interface with corresponding valve chamber lands when said valve body is located in one of said first and second positions within said valve chamber;

said spool valve being balanced without a substantial fluid pressure bias when in either of said first and second positions, and further comprising a rod which extends from said valve chamber in a direction toward said reciprocable member, said rod including a coupling portion being coupled to said bistable spring device so that said spool valve body may move in response to movement of said bistable spring device from one of said first and second states to the other one thereof.

9. A reciprocable device as recited in claim 2, wherein if said bistable spring device is initially unable to exert sufficient force to drive the valving system from one of said first and second states to the other one thereof, said reciprocable member continues its travel in the same direction, until the axial travel of the valve actuator responsive thereto acts to initiate the switching of the spool valve between its two states.

10. A reciprocable device as recited in claim 2, wherein said first and second faces are outside faces, the reciprocable member includes first and second inside faces and including an inside pickup mechanism driven by said inside faces for operating said spool valve.

11. An apparatus for pumping a fluid, said apparatus being connectible to a source of fluid to be pumped and a source of pressurized gas, said apparatus comprising:

a pump having a pumping fluid inlet and a driving gas inlet and adapted to be driven by the pressurized gas;

a first conduit for connecting the source of fluid to be pumped to the pumping fluid inlet of said pump;

a second conduit for connecting the source of pressurized gas supply source to said driving gas inlet of said pump; and a shut-off valve in said second conduit responsive to fluid pressure in the first conduit for opening said second conduit when there is sufficient pumping fluid available for pumping, thereby permitting driving gas to flow through said second conduit to drive said pump, and for closing said second conduit when there is insufficient pumping fluid available for pumping, so that the pump does not operate in a dry intake condition;

wherein said shut-off valve is configured to open at a first higher pressure in said first conduit and to close at a second lower pressure therein.

12. A system for pumping a fluid, as recited in claim 11, wherein said shut-off valve comprises a valve seat and a sealing surface adapted to be sealingly engaged with said valve seat when said valve is in its closed position, wherein a differential area ratio is established, such that the area across which upstream pressure acts is larger than the area across which downstream pressure acts, thereby increasing the stability of said shut-off valve.

13. A system for pumping a fluid, as recited in claim 12, wherein said shut-off valve further comprises a plunger-type valve having a housing enclosing a plunger valve chamber therein and a plunger valve body slidable axially within said valve chamber, said plunger valve body including said sealing surface thereon, which is adapted to engage said valve seat on said valve housing when said valve is in the closed position, such that pressurized driving gas cannot be delivered to said pump driving gas inlet, said valve seat being oriented at an angle with respect to a longitudinal axis along which said plunger valve body is oriented.

14. A reciprocable device, comprising:

a housing having a chamber therein;

a shaft in said chamber;

a reciprocable member in the chamber and having first and second reciprocable sections fixedly spaced on said shaft, each of said reciprocable sections having an outer face exposable to a driving fluid under pressure to reciprocate the reciprocable member in the chamber, and further having an inner face;

a valving system for controlling the supply and exhaust of the driving fluid under pressure to and from the first and second reciprocable section outer faces whereby the reciprocable member can be reciprocated in said chamber, said valving system being radially offset from said reciprocable member; and an inside pickup mechanism for drivingly coupling the reciprocable member and the valving system, said mechanism including an element oriented in the space between said first and second reciprocable section inner faces and arranged to be alternately contacted by each of said faces as said reciprocable member reciprocates in said housing chamber, wherein said mechanism element, responsive to said alternate contacts, initiates the actuation of said valving system between first and second states.

15. The reciprocable device as recited in claim 14, wherein said mechanism element comprises a follower shaft arranged generally parallel to said reciprocable device shaft, and said mechanism further comprises a generally radially oriented arm member drivingly coupling said follower shaft and said valving system.

* * * * *